US007047579B2

(12) United States Patent
Piana et al.

(10) Patent No.: US 7,047,579 B2
(45) Date of Patent: May 23, 2006

(54) MATTRESS RETAINER BRACKET

(75) Inventors: Joseph M. Piana, Riverview, FL (US); German Borda, Riverview, FL (US); Adam Weinman, Tampa, FL (US)

(73) Assignee: L&P Property Management, South Gate, CA (US)

( * ) Notice: Subject to any disclaimer, the term of this patent is extended or adjusted under 35 U.S.C. 154(b) by 10 days.

(21) Appl. No.: 10/806,557

(22) Filed: Mar. 23, 2004

(65) Prior Publication Data

US 2005/0210587 A1 Sep. 29, 2005

(51) Int. Cl.
*A47C 31/00* (2006.01)
*A61G 7/15* (2006.01)

(52) U.S. Cl. ..... 5/411; 5/193; 5/658; 5/618

(58) Field of Classification Search ..... 5/618, 5/617, 613, 411, 193, 660, 658, 659
See application file for complete search history.

(56) References Cited

U.S. PATENT DOCUMENTS

| | | | | | |
|---|---|---|---|---|---|
| 1,031,656 | A * | 7/1912 | Mellon | 5/193 |
| 1,371,098 | A * | 3/1921 | Jones | 5/193 |
| 3,510,887 | A * | 5/1970 | Spitz | 5/176.1 |
| 3,641,954 | A * | 2/1972 | Kalning et al. | 112/2.1 |
| 3,997,926 | A * | 12/1976 | England | 5/610 |
| 4,297,754 | A * | 11/1981 | Zuniga | 5/411 |
| 4,458,371 | A * | 7/1984 | Whitehead | 5/200.1 |
| 4,613,997 | A * | 9/1986 | Langdale | 5/611 |
| 4,899,404 | A * | 2/1990 | Galumbeck | 5/616 |
| 5,537,701 | A | 7/1996 | Elliott | 5/617 |
| 5,544,376 | A | 8/1996 | Fromson | 5/618 |
| D379,283 | S * | 5/1997 | Antinori | D6/606 |
| 5,713,091 | A * | 2/1998 | Houchin | 5/660 |
| 5,737,783 | A * | 4/1998 | Antinori | 5/411 |
| 5,978,992 | A * | 11/1999 | Antinori | 5/658 |
| 6,138,305 | A * | 10/2000 | Smith | 5/660 |
| 6,301,732 | B1 * | 10/2001 | Smith | 5/660 |
| 6,698,251 | B1 | 3/2004 | Smyre et al. | 66/193 |
| 6,889,396 | B1 * | 5/2005 | Weinman | 5/411 |
| 2003/0150058 | A1 | 8/2003 | Davis | 5/615 |
| 2004/0128762 | A1 * | 7/2004 | Weinman | 5/411 |
| 2005/0039265 | A1 * | 2/2005 | Gladney | 5/722 |
| 2005/0210587 | A1 * | 9/2005 | Piana et al. | 5/618 |

FOREIGN PATENT DOCUMENTS

| | | |
|---|---|---|
| WO | 2004/028306 | 4/2004 |

* cited by examiner

*Primary Examiner*—Robert G. Santos
(74) *Attorney, Agent, or Firm*—Wood Herron & Evans,LLP

(57) ABSTRACT

A mattress retainer for use with adjustable beds. The mattress retainer can be secured to an upper surface of a mattress support, between the mattress support and a mattress positioned thereon. In one embodiment, the mattress support is configured to engage a taped edge border of the mattress to thereby constrain movement of the mattress relative to the mattress support when the mattress support is articulated to raise and/or lower various portions of the mattress. The mattress retainer includes a channel formed on an outboard edge for receiving the taped edge border of the mattress. The taped edge border can be clamped within the channel to thereby fix the position of the mattress relative to the mattress support.

15 Claims, 4 Drawing Sheets

MATTRESS RETAINER BRACKET

FIELD OF THE INVENTION

The present invention pertains generally to bedding systems, and more particularly to a retainer for maintaining the position of a mattress on an adjustable bed.

BACKGROUND OF THE INVENTION

Adjustable beds are known in the art and provide improved comfort to persons resting thereon by permitting various portions of the sleeping surface to be selectively adjusted to different positions. Generally, these adjustable beds comprise a mattress supported on a bedframe having an adjustable mattress support. The mattress support includes one or more adjustable panels, and typically between about three and five adjustable panels. The adjustable panels are moveable from a horizontal position to permit various portions of the mattress to be raised and/or lowered to thereby provide a comfortable position for persons reclining thereon. The adjustable panels may be moved by manual manipulation of individual panels, by hand cranks, or more typically by linkages actuated by motors provided in a base of the bedframe.

When adjustable beds are operated to raise and/or lower various portions of the mattress, the mattress has a tendency to shift longitudinally on the support unless it is constrained. In the past, mattresses used on adjustable beds have been constrained by a mattress retainer in the form of a plate or rail disposed at the foot of the bedframe and extending upwardly alongside the foot of the mattress. Besides detracting from the aesthetic appearance of the bed, this type of mattress retainer also creates a barrier at the foot of the bed which may be uncomfortable to persons who are sitting on the edge of the mattress. A need therefore exists for an improved mattress retainer for use with adjustable beds which overcomes these and other drawbacks of the prior art.

SUMMARY OF THE INVENTION

The present invention provides a mattress retainer suited for use with adjustable beds to constrain movement of a mattress relative to an adjustable mattress support when the mattress support is articulated to reposition various portions of the mattress. In one embodiment, the mattress retainer is a bracket that can be secured to the upper surface of the mattress support, along opposite side edges thereof, such that the bracket is positioned between the mattress and the mattress support. A lower taped edge border of the mattress can be clamped to the bracket so that the mattress will not shift on the mattress support when the mattress support is articulated to raise and/or lower various portions of the mattress. Because the bracket is positioned beneath the mattress along the side edges thereof, the bracket does not interfere with the comfort of persons sitting or lying near the edge of the mattress.

In another embodiment, the mattress retainer comprises a bracket having a generally flat first bracket portion with apertures for securing the bracket to the mattress support with fasteners. A second bracket portion extends from the first bracket portion and has a channel formed on an outboard end thereof for receiving the taped edge border of the mattress. The taped edge border is releasably clamped within the channel by an adjustable setscrew extending through a sidewall of the channel.

In another embodiment, the mattress retainer further includes a resilient clip disposed in the channel for releasably clamping the taped edge border of the mattress. The clip includes opposed sidewalls that are spaced apart to receive the taped edge border therebetween. The spacing between the sidewalls of the clip can be adjusted by turning the setscrew so that the taped edge border can be securely clamped within the channel.

In yet another embodiment, an adjustable bed includes a plurality of adjustable support panels defining a mattress support surface, and one or more mattress retainers secured to at least one of the support panels. The mattress retainer is configured to engage a taped edge border of the mattress to thereby constrain relative movement between the mattress and the mattress support as the mattress support is articulated to adjust various portions of the mattress.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
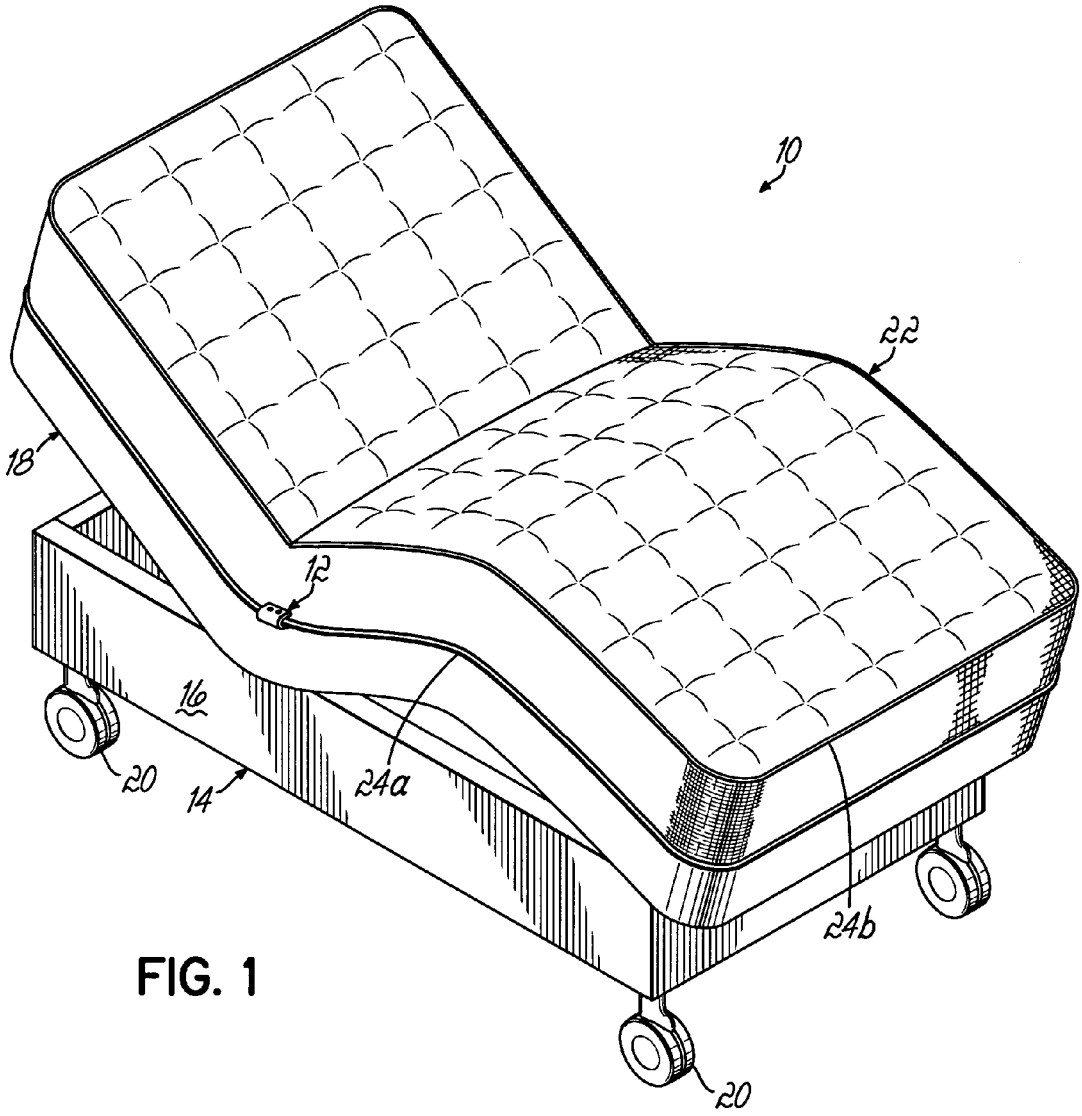
FIG. 1 is a perspective view of an adjustable bed, including an exemplary mattress retainer according to the present invention.

Referring to FIG. 1, there is shown a typical adjustable bed 10 with an exemplary mattress retainer 12 according to the present invention. The adjustable bed 10 comprises a bedframe 14 including a base 16 and an adjustable mattress support 18 disposed on a upper portion of the base 16. Casters 20 may be provided on the base 16 to facilitate repositioning the adjustable bed 10 within a room. A mattress 22 is disposed on the mattress support 18. The mattress 22 includes a taped edge border 24*a* disposed around the lower peripheral edge of the mattress 22, as known in the art. Mattress 22 may also include another taped edge border 24*b* disposed around the upper peripheral edge of the mattress.

Figure 2A:
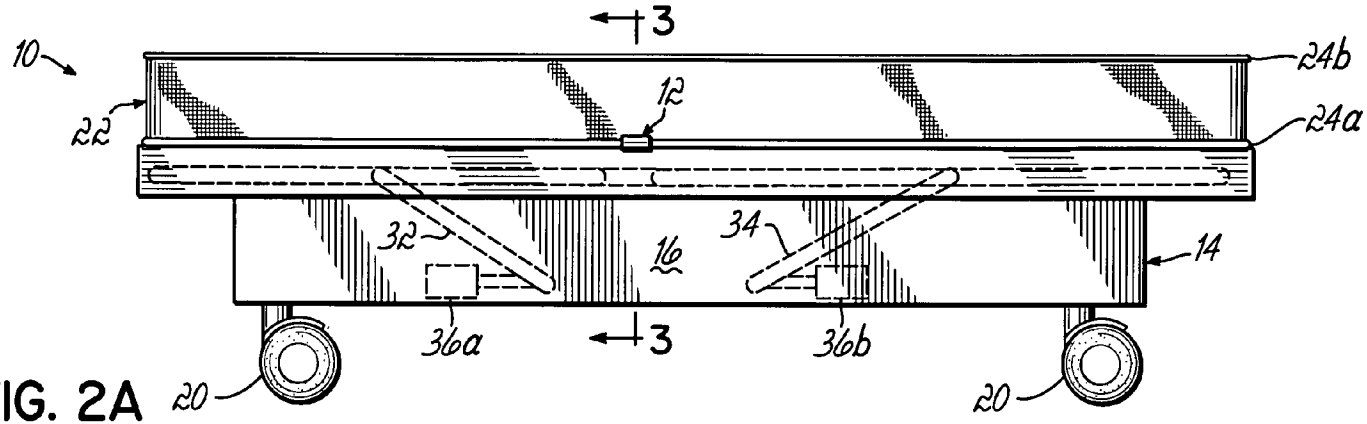
FIG. 2A is a side elevational view of the adjustable bed of FIG. 1, with the mattress disposed in a horizontal position.
Figure 2B:
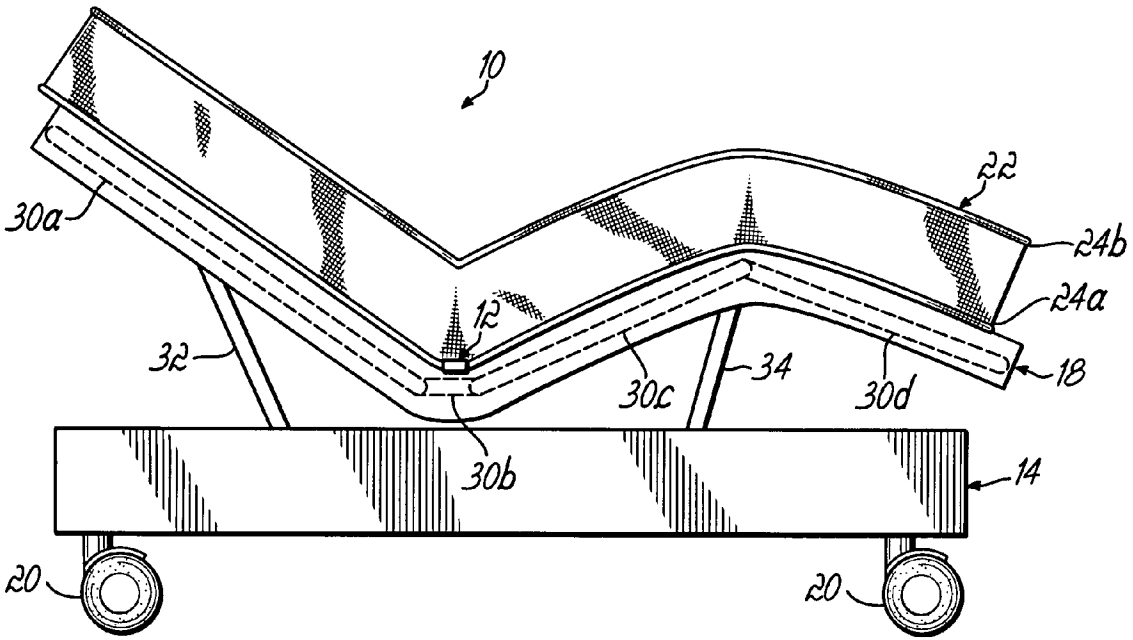
FIG. 2B is a side elevation of the adjustable bed of FIG. 2A, depicting the mattress in an adjusted configuration.

With continued reference to FIG. 1, and referring further to FIGS. 2A and 2B, a pair of mattress retainer brackets 12 (only one is visible in the figure) are disposed on the upper surface of the mattress support 18 at opposite longitudinal sides of the mattress support 18 such that the mattress retainers 12 will lie between the mattress support 18 and a mattress 22 disposed thereon. The mattress retainer brackets 12 are configured to engage the lower taped edge border 24*a* of the mattress 22. Advantageously, when various portions of the mattress are raised and/or lowered to desired positions, the retainer bracket 12 constrains the position of the mattress 22 on the mattress support 18, at least at the location of the bracket 12 on the mattress support 18. In the exemplary embodiment shown, mattress support 18 of adjustable bed 10, includes several adjustable panels 30*a*, 30*b*, 30*c*, 30*d* (collectively identified herein with reference numeral 30) which are moveable to various desired positions by linkages 32, 34 actuated by motors 36*a*, 36*b* provided in base 16. While the retainer bracket 12 is depicted as being positioned along opposite longitudinal sides of the mattress support 18 and mattress 22, it will be recognized that the mattress retainer 12 may alternatively be positioned at various other locations on the mattress support 18 to engage other portions of mattress 22.

Figure 3:
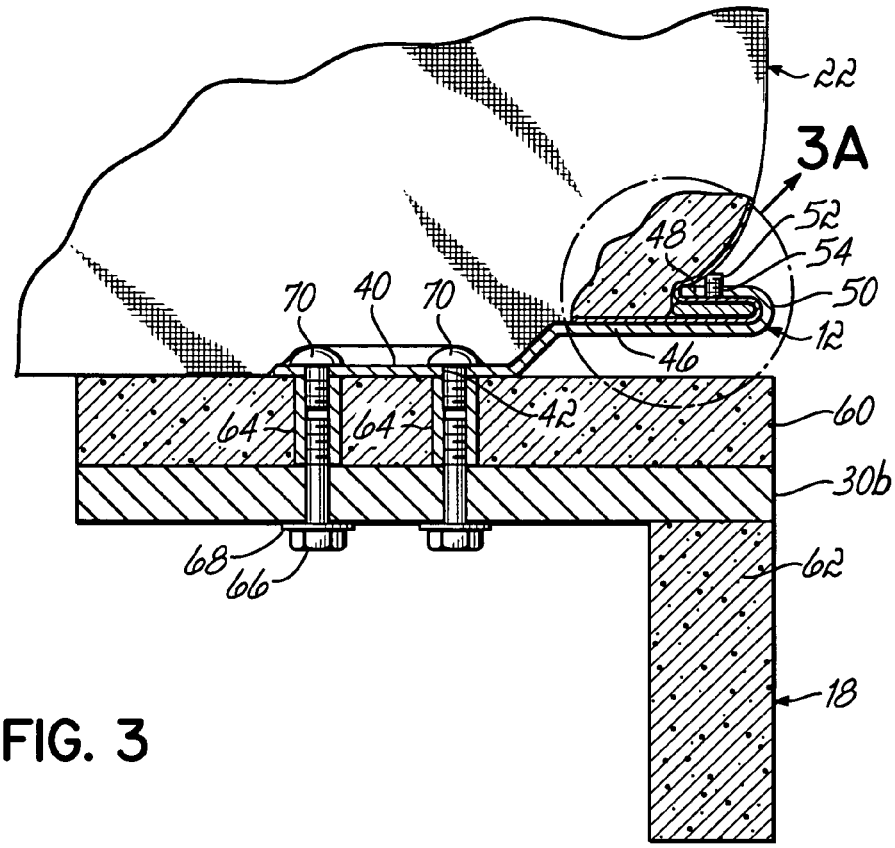
FIG. 3 is a partial cross-sectional view of the adjustable bed of FIG. 2A, taken along lines 3–3.
Figure 3A:
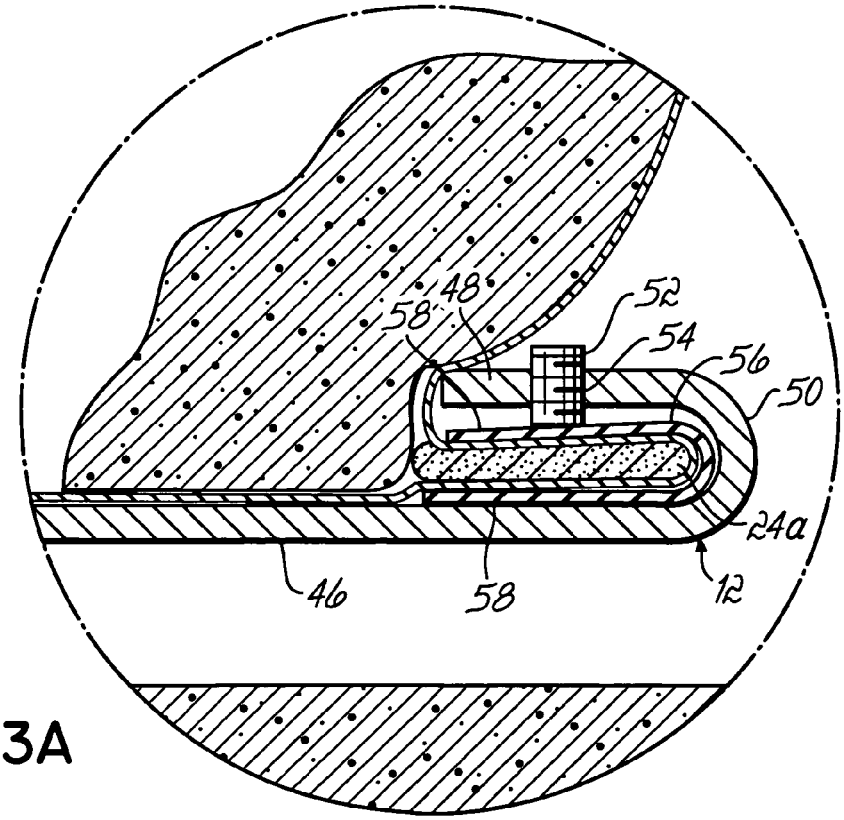
FIG. 3A is an enlarged detail view of the encircled area of FIG. 3.
Figure 4:
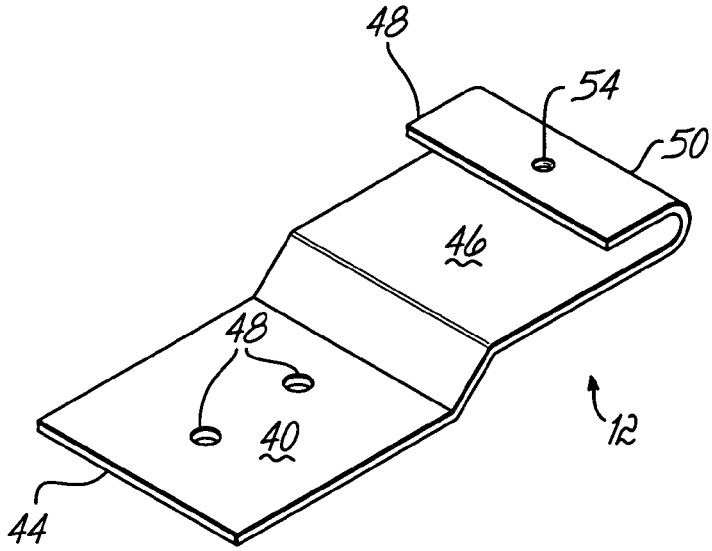
FIG. 4 is a perspective view of the mattress retainer of FIG. 3.
Figure 5:
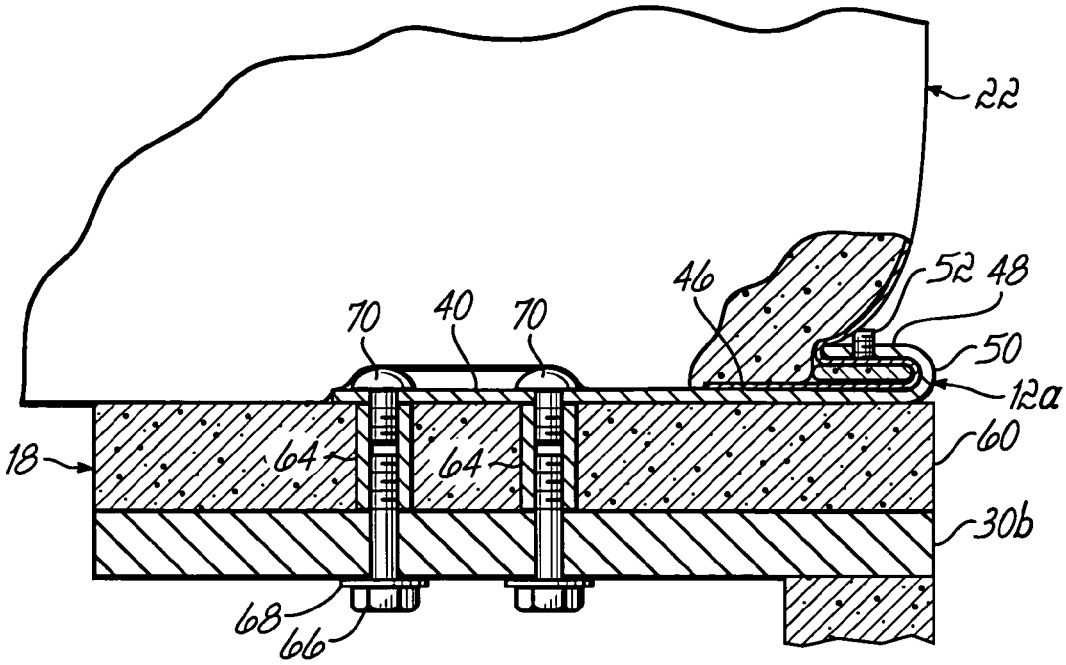
FIG. 5 is a partial cross-sectional view of the adjustable bed of FIG. 2A, depicting another embodiment of a mattress retainer according to the present invention.

Referring now to FIGS. 3, 3A and 4, one exemplary embodiment of a retainer bracket 12 according to the present invention will now be described. Bracket 12 includes a first bracket portion 40 in the form of a generally flat plate, with apertures 42 formed therethrough to facilitate securing the bracket 12 to one of the adjustable panels 30 of the mattress support 18. The bracket 12 is positioned on the mattress support 18 with an inboard side edge 44 facing toward the center of the mattress support 18. Bracket 12 further includes a second bracket portion 46 extending from the first bracket portion 40, generally in a direction opposite the inboard side edge 44 of the first bracket portion 40. In the embodiment shown, second bracket portion 46 lies in a plane parallel to, but offset from, the first bracket portion 40.

A generally c-shaped channel 48 is formed on an outboard side edge 50 of the second bracket portion 46 and extends parallel to outboard side edge 50 such that the lower taped edge border 24*a* of the mattress 22 may be received in the channel 48 when the mattress 22 is positioned on the mattress support 18. The taped edge border 24*a* of the mattress 22 is releasably clamped within the channel 48 by a setscrew 52 installed through a threaded aperture 54 formed through one of the channel walls.

As shown more clearly in FIG. 3A, the exemplary bracket 12 may include a resilient clip 56 disposed within the channel 48. The resilient clip 56 has spaced, opposed sidewalls 58 for receiving the taped edge border 24*a* therebetween. As setscrew 52 is threaded through the channel 48, the sidewalls 58 of the resilient clip 56 are pinched together to clamp the taped edge border 24*a* of the mattress 22, thereby securing the mattress 22 to the adjustable panel 30 of the mattress support 18.

In the exemplary embodiment shown, mattress support 18 comprises an adjustable panel 30*b* having a foam pad 60 disposed on an upper surface thereof. The mattress support 18 further includes a foam or fabric skirt 62 provided around the outer peripheral edge of the mattress support 18 to provide an aesthetically pleasing appearance and to simulate a box spring of a conventional bed. Internally threaded spacer tubes 64 are secured to the upper surface of the support panel 30*b* by bolts 66 and washers 68. The threaded spacer tubes 64 extend upwardly through the foam pad 60, and the bracket 12 is secured to the spacer tubes 64 by fasteners 70, such as round-head or pan-head bolts, installed through the apertures 42 provided in the first bracket portion 40 of bracket 12. In this manner, the bracket 12 is secured to the support panel 30*b*, and the mattress 22 is secured to the retainer bracket 12 such that the position of the mattress 22 on the mattress support 18 is constrained against movement when the mattress support 18 is articulated to adjust the position of the mattress 22.

Referring now to FIG. 4, there is shown another exemplary mattress retainer bracket 12*a*, according to the present invention. Bracket 12*a* is similar to the bracket 12 depicted in FIGS. 3 and 3A, and corresponding features have been similarly numbered. As depicted in FIG. 4, the first and second bracket portions 40, 46 of bracket 12*a* lie in the same plane. Bracket 12*a* is otherwise the same as bracket 12 and functions in the same way described above to constrain mattress 22 while adjustable panels 30 are moved to reposition various portions of the mattress 22.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A bracket for securing a mattress to a support surface of an adjustable bed, comprising:

a first bracket portion configured to be fixedly secured to the support surface of the bed; and a second bracket portion including a channel defined by spaced, opposing walls configured to engage the taped edge border of a mattress such that the position of the mattress on the adjustable bed remains fixed at the bracket.

2. The bracket of claim 1, wherein said first bracket portion comprises a generally flat plate having an inboard side edge and at least one aperture formed therethrough for receiving a fastener.

3. The bracket of claim 1, wherein said second bracket portion is configured to releasably clamp a taped edge border of the mattress.

4. A bracket for securing a mattress to a support surface of an adjustable bed, comprising:

a first bracket portion configured to be fixedly secured to the support surface of the bed; and a second bracket portion configured to engage the taped edge border of a mattress such that the position of the mattress on the adjustable bed remains fixed at the bracket;

wherein said first bracket portion comprises a generally flat plate having an inboard side edge and at least one aperture formed therethrough for receiving a fastener; and wherein said second bracket portion comprises a flat plate extending from said first bracket portion in a direction opposite said inboard side edge of said first bracket portion, said second bracket portion including an outboard side edge disposed opposite said first bracket portion, said outboard side edge defining a channel for receiving a taped edge border of the mattress.

5. The bracket of claim 4, wherein said first and second bracket portions are integrally formed and lie substantially in a common plane.

6. The bracket of claim 4, wherein said second bracket portion is offset from said first bracket portion such that said second bracket portion lies substantially in a plane parallel to a plane containing said first bracket portion.

7. The bracket of claim 4, wherein said second bracket portion includes at least one tapped hole, proximate said channel, for receiving a threaded fastener to releasably clamp the taped edge border of the mattress within said channel.

8. The bracket of claim 4, further comprising a resilient clip disposed within said channel.

9. The bracket of claim 8, wherein said resilient clip comprises spaced opposed sidewalls for receiving the taped edge border of the mattress, at least one of said sidewalls movable in a direction toward the other of said sidewalls such that the taped edge border can be clamped therebetween.

10. An adjustable bed, comprising:

a plurality of support panels defining a mattress support surface, at least one of said support panels movable relative to other ones of said support panels to thereby adjust the bed; and a bracket secured to one of said support panels and including a generally C-shaped channel defined by spaced, opposing walls configured to engage a taped edge border of a mattress such that the position of the mattress on said mattress support surface is fixed at said bracket.

11. The adjustable bed of claim 10, further comprising a mattress disposed on said support surface and having a taped edge border engaged with said bracket.

12. The adjustable bed of claim 10, wherein said bracket comprises:

a first bracket portion configured to be fixedly secured to one of said panels of the adjustable bed; and a second bracket portion configured to engage the taped edge border of a mattress such that the position of the mattress relative to said support panel remains fixed at the bracket.

13. The adjustable bed of claim 12, wherein said second bracket portion is configured to releasably clamp the taped edge border of the mattress.

14. An adjustable bed, comprising:

a plurality of support panels defining a mattress support surface, at least one of said support panels movable relative to other ones of said support panels to thereby adjust the bed: and a bracket secured to one of said support panels and including a channel defined by spaced. opposing walls configured to engage a taped edge border of a mattress such that the position of the mattress on said mattress support surface is fixed at said bracket; said bracket comprising a first bracket portion configured to be fixedly secured to one of said panels of the adjustable bed, and a second bracket portion configured to engage the taped edge border of a mattress such that the position of the mattress relative to said support panel remains fixed at the bracket;

said first bracket portion comprising a generally flat plate having an inboard side edge and at least one aperture formed therethrough for receiving a fastener;

said second bracket portion comprising a flat plate extending from said first bracket portion in a direction opposite said inboard side edge of said first bracket portion, said second bracket portion including an outboard side edge disposed opposite said first bracket portion, said outboard side edge defining the channel for receiving the taped edge border of the mattress.

15. A method of securing a mattress to the support surface of an adjustable bed, the method comprising:

positioning the mattress on the support surface; and clamping a taped edge border of the mattress to the support surface with a bracket having a generally C-shaped channel defined by opposing side walls configured to receive the taped edge border therebetween.

* * * * *